US009728332B2

(12) United States Patent
Kim et al.

(10) Patent No.: US 9,728,332 B2
(45) Date of Patent: Aug. 8, 2017

(54) WIRE ROD AND STEEL WIRE HAVING SUPERIOR MAGNETIC CHARACTERISTICS, AND METHOD FOR MANUFACTURING SAME

(75) Inventors: Dong-Hyun Kim, Pohang-si (KR); You-Hwan Lee, Pohang-si (KR); Woo-Gi Shin, Pohang-si (KR)

(73) Assignee: POSCO, Pohang-si (KR)

( * ) Notice: Subject to any disclaimer, the term of this patent is extended or adjusted under 35 U.S.C. 154(b) by 797 days.

(21) Appl. No.: 13/824,428

(22) PCT Filed: Nov. 9, 2011

(86) PCT No.: PCT/KR2011/008515

§ 371 (c)(1),
(2), (4) Date: Mar. 18, 2013

(87) PCT Pub. No.: WO2012/064104

PCT Pub. Date: May 18, 2012

(65) Prior Publication Data

US 2013/0189148 A1 Jul. 25, 2013

(30) Foreign Application Priority Data

Nov. 10, 2010 (KR) ..... 10-2010-0111614

(51) Int. Cl.

| | |
|---|---|
| ***H01F 41/02*** | (2006.01) |
| ***C21D 8/06*** | (2006.01) |
| ***C21D 8/12*** | (2006.01) |
| ***C22C 38/00*** | (2006.01) |
| ***C22C 38/04*** | (2006.01) |
| ***C22C 38/06*** | (2006.01) |
| ***H01F 1/14*** | (2006.01) |
| ***B21C 1/00*** | (2006.01) |
| ***H01F 1/01*** | (2006.01) |
| ***C22C 38/02*** | (2006.01) |

(52) U.S. Cl.

CPC ..... *H01F 41/02* (2013.01); *B21C 1/00* (2013.01); *C21D 8/06* (2013.01); *C21D 8/065* (2013.01); *C21D 8/12* (2013.01); *C22C 38/001* (2013.01); *C22C 38/02* (2013.01); *C22C 38/04* (2013.01); *C22C 38/06* (2013.01); *H01F 1/01* (2013.01); *H01F 1/143* (2013.01)

(58) Field of Classification Search

CPC . H01F 1/01; H01F 1/143; H01F 41/02; C22C 38/001; C22C 38/02; C22C 38/04; C22C 38/06; C21D 8/06; C21D 8/065; C21D 8/12; B21C 1/00

See application file for complete search history.

(56) References Cited

U.S. PATENT DOCUMENTS

| | | | | |
|---|---|---|---|---|
| 5,051,138 | A * | 9/1991 | Iwanaga | C21D 8/1211 148/111 |
| 6,451,128 | B1 | 9/2002 | Lee et al. | |
| 6,921,511 | B2 | 7/2005 | Bourgin et al. | |

FOREIGN PATENT DOCUMENTS

| | | | |
|---|---|---|---|
| CN | 1692164 | | 11/2005 |
| EP | 0394696 | A1 | 10/1990 |
| EP | 0577124 | A2 | 1/1994 |
| EP | 1179603 | A2 | 2/2002 |
| JP | 05-125445 | | 5/1993 |
| JP | 05-230534 | | 9/1993 |
| JP | 06-145802 | | 5/1994 |
| JP | 07-258738 | | 10/1995 |
| JP | 2000045051 | A | 2/2000 |
| JP | 2001-040416 | | 2/2001 |
| JP | 2001115241 | A | 4/2001 |
| JP | 2001131718 | A | 5/2001 |
| JP | 2003213382 | A | 7/2003 |
| JP | 2004-353052 | A | 12/2004 |
| JP | 2004-363512 | A | 12/2004 |
| JP | 2005-002399 | A | 1/2005 |
| JP | 2005-226118 | | 8/2010 |
| JP | 2010-201487 | | 9/2010 |
| KR | 1020040057215 | A | 7/2004 |

OTHER PUBLICATIONS

Muroya et al., English machine translation of JP 2010-201487, Sep. 2010, Japan, p. 1-14.*
Glodowski, R.J., "Steel Wire Rod", ASM Handbook, 1990, ASM International, vol. 1, p. 1-2.*
Dove, A.B., "Steel Wire", ASM Handbook, 1990, ASM International, vol. 1, p. 1-7.*
Iwanaga et al., English machine translation of JP 07-258738, Oct. 1995, p. 1-12.*

* cited by examiner

*Primary Examiner* — Roy King
*Assistant Examiner* — Caitlin Kiechle
(74) *Attorney, Agent, or Firm* — The Webb Law Firm

(57) ABSTRACT

A wire rod and steel wire having superior magnetic characteristics and a method for manufacturing same, wherein the wire rod and the steel wire can be used in transformers, vehicles, electric or electronic products, or the like which require low iron loss and high permeability. Provided are a wire rod and steel wire having superior magnetic characteristics and a method for manufacturing same, wherein the wire rod or the steel wire comprises, by wt %, 0.03 to 0.05% of C, 3.0 to 5.0% of Si, 0.1 to 2.0% of Mn, 0.02 to 0.08% of Al, 0.0015 to 0.0030% of N, and the remainder being Fe and unavoidable impurities. The wire rod and steel wire having directional properties may be provided by a general manufacturing process without using expensive alloying elements and without having to add a manufacturing facility.

7 Claims, 2 Drawing Sheets

WIRE ROD AND STEEL WIRE HAVING SUPERIOR MAGNETIC CHARACTERISTICS, AND METHOD FOR MANUFACTURING SAME

TECHNICAL FIELD

The present invention relates to a wire rod and steel wire having superior magnetic characteristics, and a method of manufacturing the same, and more particularly, to a wire rod and steel wire having superior magnetic characteristics, and to a method of manufacturing the same, wherein the wire rod and the steel wire may be used in transformers, vehicles, electrical or electronic products, or the like, requiring lower degrees of iron loss and high permeability.

BACKGROUND ART

Grain-oriented or non grain-oriented electrical steel has been used as a material for iron cores of most of medium to large sized transformers. In particular, as techniques having higher efficiency, as compared with existing techniques, and the necessity of research and development for the miniaturization and lightening of machines are required, research and development aimed at methods of producing high grade grain-oriented electrical steel is absolutely indispensable.

In particular, since grain-oriented electrical steel has to be easily magnetized and has to have high magnetic characteristics in a rolled direction thereof, a texture structure appearing when silicon (Si) is excessively added to ultra low carbon steel has to be artificially formed. However, such grain-oriented electrical steel may exhibit the characteristics of high grade grain-oriented electrical steel when a silicon (Si) component is contained in an amount of not less than 6.5% so as to enhance the magnetic properties thereof.

Also, the grain-oriented electrical steel is disadvantageous in that it has to be subject to a heat treatment at a high temperature and a nitrogen atmosphere so as to artificially form a texture structure known as a Goss structure. This is because the <100> crystal orientation that has a maximum magnetic induction value has to be controlled.

Meanwhile, although a method capable of improving the magnetic properties of electrical steel through control of the texture structure or a surface coating has been recently proposed, electrical steel used for transformers requires precision processing for suppressing tears, shearing, or bending of the electrical steel sheet that may be caused when the electrical steel strips are stacked. In the case in which an iron core is comparatively small, it is difficult to process the electrical steel strip, a volume of a portion of the core distorted by processing of steel to the overall volume of the core increases relatively, and thus the magnetic properties may be remarkably reduced.

To solve the above-mentioned limitations, a technique in which an electronic steel wire or an electrical steel wire is manufactured and then a wire rod for a small motor provided in a small transformer or a vehicle is manufactured has been developed. When electrical steel is manufactured in the form of a wire rod, a severe process control for rolling and surface defect suppression is not necessary and a yield drop due to lamination of electrical steel strips may be solved.

Japanese Unexamined Patent Application Publication No. 2001-115241 discloses a representative technique. The above-mentioned technique is to manufacture a material for electrical steel having excellent drawing workability, especially cold drawing workability as rolled, and discloses a component system containing Si in an amount range of 0.1-8% and C+N+O+S in a sum amount of not more than 0.015%. However, since the technique controls the content of carbon to an ultra low value, a Ruhrstahl-Heraues (RH) degassing process has to be added, and since composite deoxidization has to be performed with a relatively long vacuum degassing time, an increase in process costs is inevitable. Also, since chromium (Cr) has to be added up to a content range of 0.1-15% so as to enhance magnetic properties, a cost increase due to the addition of alloy elements is also inevitable.

One of techniques for compensating for the defects in the of the above patent process is that disclosed in Japanese Unexamined Patent Application Publication No. 2000-045051. The above patent discloses a silicon steel wire with a small deterioration in core loss and excellent workability in which the contents of carbon (C), nitrogen (N), oxygen (O), and sulfur (S) are controlled to, by weight, C+S+O+N<0.015%, the average grain size and the diameter of a wire rod after being drawn are controlled, and ≤2% Ni,≤2% Al, and ≤2% Cu are further added as alloy elements. However, the silicon steel wire disclosed in the above patent has drawbacks, such as an increase in manufacturing costs thereof due to an increase of additional contents of alloy elements, a lack of suggestions on magnetic properties through processes such as hot rolling, and a lack of clear suggestions on texture structure fraction.

Meanwhile, Japanese Unexamined Patent Application Publication No. 2001-131718 discloses steel wire in which the total content of C, S, O and N is suppressed to ≤0.025 wt. %, and the diameter of a drawn wire is controlled to 0.01 to 1.0 mm. However, the above patent also requires the essential addition of relatively highly priced alloy elements, for example, Cr, Ni, Cu, and the like, and has drawbacks, such as lack of suggestions for a concrete structure with regard to magnetic properties, and lack of suggestions for values of magnetic properties.

In particular, all of the above-mentioned patents have a common drawback, in that the magnetic properties of the silicon steel wires have values close to those of non grain-oriented electrical steels and a subsequent annealing treatment has to be performed so as to increase magnetic properties.

DISCLOSURE

Technical Problem

An aspect of the present invention provides a wire rod and steel wire having superior magnetic characteristics by controlling alloy components to activate a Goss structure through a typical groove rolling process using a general low carbon steel instead of an ultra low carbon steel, and a method for manufacturing the same.

Technical Solution

According to an aspect of the present invention, there is provided a wire rod having superior magnetic characteristics, including, by weight, carbon (C): 0.03 to 0.05%, silicon (Si): 3.0 to 5.0%, manganese (Mn): 0.1 to 2.0%, aluminum (Al): 0.02 to 0.08%, nitrogen (N): 0.0015 to 0.0030%, the balance: iron (Fe), and other unavoidable impurities.

The wire rod may include a Goss structure of not less than 2 area %, and a saturated magnetic flux density of not less than 180 emu.

According to another aspect of the present invention, there is provided steel wire having superior magnetic characteristics, including, by weight, C: 0.03 to 0.05%, Si: 3.0 to 5.0%, Mn: 0.1 to 2.0%, Al: 0.02 to 0.08%, N: 0.0015 to 0.0030%, the balance: Fe, and other unavoidable impurities.

The steel wire may include a Goss structure of not less than 7 area %, and a saturated magnetic flux density of not less than 250 emu.

According to an aspect of the present invention, there is provided a method for manufacturing a wire rod having superior magnetic characteristics, the method including heating steel including, by weight, C: 0.03 to 0.05%, Si: 3.0 to 5.0%, Mn: 0.1 to 2.0%, Al: 0.02 to 0.08%, N: 0.0015 to 0.0030%, the balance: Fe, and other unavoidable impurities, at a temperature of 1000-1100° C., and groove-rolling the heated steel.

The groove-rolling may be performed at a temperature of 900-1000° C. at a cross-section reduction ratio of 50-80%. After the groove-rolling, the groove-rolled steel may be cooled at a rate of 0.1° C./s.

The present invention provides a method of manufacturing steel wire having superior magnetic characteristics, including drawing the wire rod manufactured by the above manufacturing method.

The drawing may be performed at a cross-section reduction ratio of 10-80%.

Advantageous Effects

According to the present invention, a wire rod and steel wire having grain-orientation may be provided only by using a typical manufacturing process without using relatively expensive alloy elements and adding a manufacturing facility.

BEST MODE

The present inventors carried out research to impart superior magnetic characteristics to a general low carbon steel wire rod, and perceived that it is possible to manufacture a wire rod and steel wire having high magnetic characteristics only through hot rolling, by controlling the composition components. In this case, the hot rolling means groove-rolling.

Figure 1:
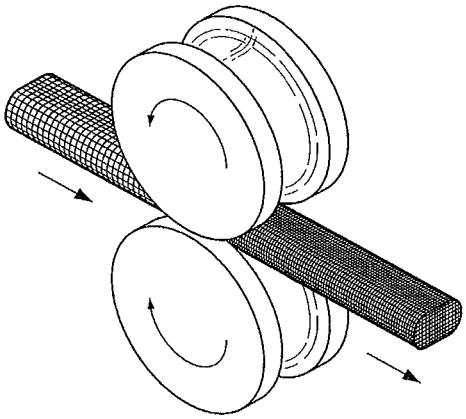
FIG. 1 is a schematic view illustrating a variation in a structure when a wire rod is rolled through a simulation of groove-rolling.

FIG. 1 is a schematic view illustrating a variation in structure when a wire rod is rolled through a simulation of groove-rolling. As seen from FIG. 1, the present inventors completed the present invention on the basis that a large amount of Goss structure having an influence on the magnetic properties may be created by rolling a wire rod in one direction using the characteristic of the groove-rolling to cause strain in a structure of the wire rod.

Hereinafter, the present invention will be described in detail.

Carbon (C): 0.03 wt % to 0.05 wt %

C is in a solid solution in the wire rod causing lattice distortion and aging and at the same time reducing ductility. When C is added in an amount of less than 0.03 wt %, a uniform Goss structure may not be formed in the wire rod, and when C exceeds 0.05 wt %, magnetic properties may be reduced. Accordingly, the content C is preferably limited to a range of 0.03-0.05 wt %.

Silicon (Si): 3.0-5.0 wt %

Si is a component effective in increasing the electrical resistance of the wire rod and thus enhancing magnetic properties. However, when Si is added in an amount of less than 3 wt %, magnetic properties are reduced due to lack of an added amount, and when Si exceeds 5 wt %, the work hardening rapidly progresses to make it impossible to roll the wire rod. Accordingly, the content of Si is preferably limited to a range of 3.0-5.0 wt %.

Manganese (Mn): 0.1 wt % to 2.0 wt %

Mn is a useful component to enhance the electrical resistance of the wire rod and the iron loss characteristics. However, when Mn is added in an amount of less than 0.1 wt %, it fails to compensate for the reduction in strength during rolling, and when Mn exceeds 2.0 wt %, a problem in hot rolling may be caused due to an increase in a work hardening effect as in Si. Accordingly, the content of Mn is preferably limited to a range of 0.1 wt % to 2.0 wt %.

Aluminum (Al): 0.02 wt % to 0.08 wt %

Since Al is an effective element in controlling nitrogen in steel and thus enhancing magnetic properties, it is preferable to limit the amount of Al in line with the control range of nitrogen. When Al is added in an amount of less than 0.02 wt %, it fails to effectively control nitrogen, and when Al is added in excess of 0.08 wt %, Al may be precipitated in an atom state to deteriorate magnetic properties. Accordingly, the amount of Al is preferably limited to a range of 0.02 wt % to 0.08 wt %.

Nitrogen (N): 0.0015 wt % to 0.003 wt %

N suppresses the formation of a Goss structure through lattice distortion due to impregnation into a crystal lattice and the formation of nitrides with alloy elements, and serves as a factor causing aging reducing and ductility. Since the control of N to an amount of less than 0.0015 wt % is a very involved process in a steel manufacturing process, it may not be realized in an actual process. When N is added in an amount of more than 0.003 wt %, N may freely move in steel and increase the amount of Al and increase the possibility of the creation of coarse AlN. Accordingly, the amount of N is preferably limited to a range of 0.0015 wt % to 0.003 wt %.

By limiting the compositional range as above, superior magnetic characteristics, i.e., directional properties, may be imparted to the wire rod.

In the case of a typical electrical steel sheet, the Goss structure is created in an amount of less than 2 area %, whereas the wire rod of the present invention includes the Goss structure of not less than 2 area %. Thus, since a greater amount of Goss structure is created in the wire rod of the present invention, compared with the existing electrical steel sheet or wire rod having magnetic characteristics, the wire rod of the present invention has superior magnetic characteristic, i.e., directional properties. In more detail, surrounding structures vary toward the direction of the Goss structure on the basis of the created Goss structure during annealing, thereby enhancing magnetic characteristics. That is, the Goss structure may act as an effective directional promoter to enable movement of magnetic momentums and to allow surrounding structures to be easily magnetized during annealing, and especially, since the Goss structure may exhibit magnetic properties in a direction perpendicular to the rolling direction, as well as in the rolling direction, it is an essential structure for steel that may exhibit magnetic properties. However, when the Goss structure is created in an amount of less than 2%, the directional properties may not be imparted to the wire rod, so that the wire rod has non grain-directional magnetic characteristics. That is, it is better that the Goss structure be created to be as large as possible, but the upper limit of the Goss structure is limited to 10% due to the process limitation.

Also, the wire rod has a saturated magnetic flux density of not less than 180 emu. When the saturated magnetic flux density is less than 180 emu, it is difficult to impart the directional properties to the wire rod, so that the wire rod may have non-directional magnetic characteristics. Like the Goss structure, it is advantageous for magnetic characteristics that the saturated magnetic flux density be as high as possible, but the upper limit is limited to 280 emu due to the process limitation.

The present invention provides steel wire using the wire rod as well as the above-mentioned wire rod, in which the wire rod is drawn to impart superior magnetic characteristics to the steel wire. At this time, the steel wire may include a Goss structure of not less than 7 area %, and a saturated magnetic flux density of not less than 250 emu. However, in the case of the steel wire, the upper limits of the Goss structure and the saturated magnetic flux density are limited to 14 area % and 300 emu, respectively, due to process limitations.

When the wire rod of the present invention satisfies the compositional range, the wire rod has superior magnetic characteristics although it is manufactured under typical groove-rolling conditions. Therefore, the groove-rolling conditions and other manufacturing conditions are not particularly limited.

An example of a method for manufacturing a wire rod to more preferably realize the present invention is as follows.

First, steel satisfying a composition range of the present invention is heated at a temperature of 1000-1100° C. In the case in which the heating temperature is less than 1000° C. in the wire rod process, when the steel is extracted from a heating furnace and then rough-rolled, surface defects may be generated due to an increase in severe strain, and when the heating temperature exceeds 1000° C., product quality may be deteriorated due to the limitation of the heating furnace and an increase in surface scale.

Thereafter, the reheated steel is subject to groove-rolling. The groove-rolling is an essential process in the wire rod rolling, and allows the structure in the wire rod to be rolled in one direction to cause strain, so that creation of a text structure participating in the magnetic characteristics, i.e., a Goss structure, may be activated. Thus, the groove-rolling in a hot state may impart superior magnetic characteristics to the wire rod.

The groove-rolling is preferably performed at a temperature of 900-1000° C. However, when the groove-rolling is performed at a temperature of less than 900° C., surface defects may be caused in the wire rod due to process load and fracturing of a wire rod rolling roller may occur. When the temperature of the groove-rolling exceeds 1000° C., strain may not be effectively generated due to an increase in ductility during rolling.

In the groove-rolling, the cross-section reduction rate is preferably in a range of 50-80%. When the cross-section reduction rate is less than 50%, the Goss structure is insufficiently created due to the lack of strain, so that it may be impossible to distribute the structure to the magnetic wire rod. When the cross-section reduction rate exceeds 80%, a recrystallization force increases due to severe extension of the wire rod structure, so that the Goss structure itself may be transformed.

Also, after the groove-rolling, a cooling process is preferably performed at a cooling rate of not more than 0.1° C./s. When the cooling rate exceeds 0.1° C./s, a low temperature structure is created in the structure and thus the possibility of transformation to a ferrite structure increases.

After the above-mentioned wire rod manufacturing process, a drawing process may be further performed to thus manufacture steel wire, thereby further enhancing the magnetic characteristics of the wire rod. The cross-section reduction rate in the drawing process is preferably in a range of 10-80%. However, when the cross-section reduction rate is less than 10%, the drawing amount may be insufficient and thus the Goss structure does not increase. It is preferable to increase the drawing amount by as much as possible. However, when the cross-section reduction rate exceeds 80%, the wire rod may be fractured during drawing due to the limitation of drawing. Accordingly, the cross-section reduction rate is preferably limited to a range of 10-80%. More preferably, the cross-section reduction rate is in a range of 50-80%. Most preferably, the cross-section reduction rate is in a range of 70-80%, in which the Goss structure occupies 11.5 area % or more.

Hereinafter, the present invention will be described in detail with reference to examples. However, the following examples are described to more specifically explain the present invention and are not intended to limit the scope of the present invention.

Example 1

Steels having compositions listed in table 1 below were heated under the conditions of table 2 and then were subject to groove-rolling. In wire rods manufactured through the manufacturing conditions, the fraction of the Goss structure and the saturated magnetic flux density were measured and shown in the below table 2.

TABLE 1

| | Composition (wt %) | | | | | | |
|---|---|---|---|---|---|---|---|
| Item | C | Si | Mn | P | S | Al | N |
| Comparative Steel 1 | 0.06 | 1.0 | 0.1 | 0.01 | 0.007 | — | 0.002 |
| Comparative Steel 2 | 0.06 | 2.0 | 0.1 | 0.01 | 0.007 | — | 0.002 |
| Comparative Steel 3 | 0.06 | 3.0 | 0.1 | 0.01 | 0.007 | — | 0.002 |
| Comparative Steel 4 | 0.06 | 4.0 | 0.1 | 0.01 | 0.007 | — | 0.002 |
| Inventive Steel 1 | 0.031 | 3.0 | 0.185 | 0.011 | 0.007 | 0.023 | 0.002 |
| Inventive Steel 2 | 0.045 | 3.1 | 0.15 | 0.01 | 0.007 | 0.020 | 0.002 |

TABLE 1-continued

| Item | Composition (wt %) | | | | | | |
|---|---|---|---|---|---|---|---|
| | C | Si | Mn | P | S | Al | N |
| Inventive Steel 3 | 0.042 | 3.2 | 0.99 | 0.01 | 0.007 | 0.040 | 0.002 |
| Inventive Steel 4 | 0.047 | 3.26 | 0.98 | 0.01 | 0.007 | 0.041 | 0.002 |
| Inventive Steel 5 | 0.044 | 3.05 | 0.98 | 0.01 | 0.007 | 0.08 | 0.002 |
| Inventive Steel 6 | 0.03 | 3.0 | 0.1 | 0.01 | 0.007 | 0.02 | 0.002 |
| Inventive Steel 7 | 0.03 | 3.0 | 0.1 | 0.01 | 0.007 | 0.04 | 0.002 |
| Inventive Steel 8 | 0.03 | 5.0 | 0.1 | 0.01 | 0.007 | 0.02 | 0.002 |
| Inventive Steel 9 | 0.03 | 5.0 | 0.1 | 0.01 | 0.007 | 0.04 | 0.002 |

TABLE 2

| Sample No. | Item | Heating Temp. (° C.) | Groove-rolling Temp. (° C.) | Cross-section Reduction Rate (%) | Cooling Rate (° C./s) | Goss Structure Fraction (Area %) | Saturated Magnetic Flux Density (emu) |
|---|---|---|---|---|---|---|---|
| Comparative Steel 1 | Comparative Material 1 | 1100 | 850 | 40 | 0.1 | 0.6 | 142 |
| Comparative Steel 2 | Comparative Material 2 | 1100 | 900 | 30 | 0.1 | 0.5 | 134 |
| Comparative Steel 3 | Comparative Material 3 | 1100 | 900 | 60 | 0.1 | 0.71 | 145 |
| Comparative Steel 4 | Comparative Material 4 | 1100 | 900 | 50 | 0.1 | 0.3 | 123 |
| Inventive Steel 1 | Inventive Material 1 | 1100 | 900 | 60 | 0.1 | 2.4 | 198 |
| Inventive Steel 2 | Inventive Material 2 | 1100 | 900 | 50 | 0.1 | 2.2 | 186 |
| Inventive Steel 3 | Inventive Material 3 | 1100 | 900 | 80 | 0.1 | 6.7 | 255 |
| Inventive Steel 4 | Inventive Material 4 | 1100 | 900 | 50 | 0.1 | 2.0 | 181 |
| Inventive Steel 5 | Inventive Material 5 | 1100 | 900 | 70 | 0.1 | 4.0 | 213 |
| Inventive Steel 6 | Comparative Material 5 | 1100 | 850 | 60 | 0.1 | 0.81 | 151 |
| Inventive Steel 7 | Comparative Material 6 | 1100 | 900 | 40 | 0.1 | 0.68 | 144 |
| Inventive Steel 8 | Camparative Material 7 | 1100 | 900 | 80 | 0.2 | 0.74 | 146 |
| Inventive Steel 9 | Comparative Material 8 | 1100 | 1050 | 50 | 0.1 | 0.65 | 142 |

Figure 2:
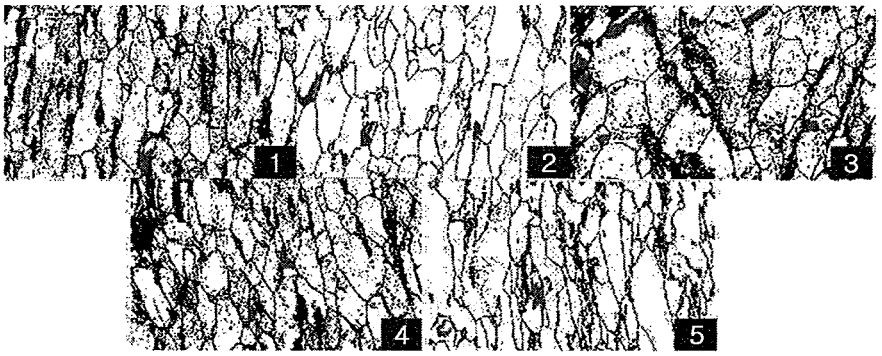
FIG. 2 is EBSD microstructure photographs of Inventive Materials 1-5 according to an embodiment of the present invention.

FIG. 2 is EBSD microstructure photographs of Inventive Materials 1 to 5, in which red portions indicate Goss structures. As seen from FIG. 2 and Table 2, the wire rods of Inventive Materials 1 to 5 satisfying the composition range of the present invention have the Goss structure ranging from 2.0% to 6.7%. The typical grain-oriented electrical steel sheet after hot rolling has a Goss structure of which the fraction is less than 2%, whereas Inventive Materials 1 to 5 show the activation of the Goss structure, for example, Inventive Material 4 having the poorest characteristics has the Goss structure of 2%. From these results, it can be seen that the wire rod of the present invention has higher magnetic characteristics than the existing grain-oriented steel sheet.

Figure 3:
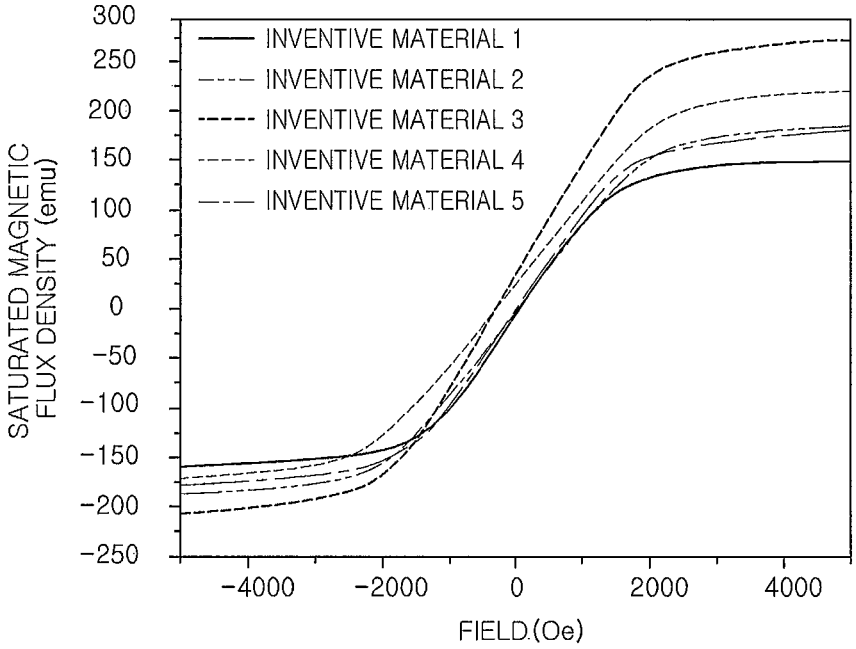
FIG. 3 is a graph illustrating emu measurement values of Inventive Materials 1-5 according to an embodiment of the present invention.

Also, it can be seen that Inventive Materials 1 to 5 exhibit superior magnetic characteristics in that they have a saturated magnetic flux density ranging from 181 emu to 255 emu, which is greater than 180 emu. FIG. 3 is a graph showing measurement results of the saturated magnetic flux density as measured using VSM (Vibration Sample Measurement).

It can be confirmed that among others, Inventive Material 3 has the most excellent saturated magnetic flux density. The reason is that Inventive Material 3 has optimal carbon and silicon contents to suppress solid solution or an aging phenomenon in carbon in the crystal lattice and AlN formed by adding Al suppresses the generation of nitrogen to maximize lattice stability, thus activating the Goss structure.

Figure 4A:
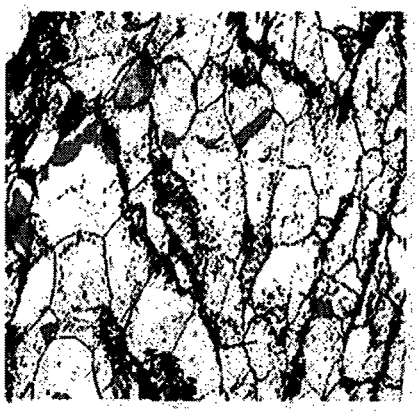
FIG. 4 is (a) an EBSD (Electron Back Scattered Diffraction) microstructure photograph and (b) is an EBSD scanning photograph of Inventive Material 3 according to an embodiment of the present invention.
Figure 4B:
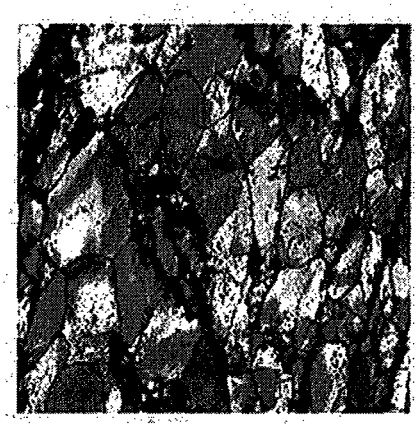

FIG. 4 shows an EBSD microstructure photograph (left) and an EBSD scanning photograph (right) of Inventive Material 3. In the EBSD microstructure photograph of the left of FIG. 4, a black portion indicates a grain boundary and a red portion indicates a Goss structure. From FIG. 3, it can be seen that Inventive Material 3 has excellent magnetic characteristics having a Goss structure of 6.7%. Also, in the EBSD scanning photograph, the red portion indicates a portion that may be transformed into the Goss structure through a subsequent additional process.

However, it is confirmed that Comparative Materials 1 to 4 that do not correspond to the compositional range of the present invention have remarkably low saturated magnetic flux density values as compared with the Inventive Materials. Also, it can be seen that Comparative Materials 5 to 8 which satisfy the compositional range of the present invention but do not satisfy the manufacturing conditions have low Goss structure fractions and low saturated magnetic flux densities, and thus have poor magnetic characteristics.

Example 2

The above-mentioned Comparative Materials and Inventive Materials were subject to a drawing process under the conditions of the below table 3, then Goss structure fractions and saturated magnetic flux densities were measured, and measurement results are shown in the below table 3.

TABLE 3

| Sample No. | Item | Cross-section Reduction Rate in Drawing (%) | Goss Structure Fraction (area %) | Saturated Magnetic Flux Density (emu) |
|---|---|---|---|---|
| Comparative Steel 1 | Comparative Material 1 | 20 | 2.1 | 227 |
| Comparative Steel 2 | Comparative Material 2 | 30 | 1.1 | 187 |
| Comparative Steel 3 | Comparative Material 3 | 40 | 1.8 | 195 |
| Comparative Steel 4 | Comparative Material 4 | 50 | 2.1 | 233 |
| Inventive Steel 1 | Inventive Material 1 | 60 | 10.8 | 275 |
| Inventive Steel 2 | Inventive Material 2 | 70 | 11.5 | 285 |
| Inventive Steel 3 | Inventive Material 3 | 80 | 13.2 | 295 |
| Inventive Steel 4 | Inventive Material 4 | 50 | 9.9 | 271 |
| Inventive Steel 5 | Inventive Material 5 | 70 | 12.1 | 289 |
| Inventive Steel 6 | Comparative Material 5 | 20 | 7.2 | 257 |
| Inventive Steel 7 | Comparative Material 6 | 30 | 8.6 | 263 |
| Inventive Steel 8 | Comparative Material 7 | 40 | 8.3 | 259 |
| Inventive Steel 9 | Comparative Material 8 | 90 | 6.5 | 251 |

From table 3, it can be seen that the steel wires manufactured through the drawing process have an increased Goss structure fraction above a predetermined level, compared with the wire rods. In particular, it is shown that Inventive Materials 1 to 5 satisfying the conditions of the present invention have a Goss structure fraction of not less than 9.9 area % and a saturated magnetic flux density of not less than 271 emu. From these results, it can be seen that the steel wires of the present invention have excellent magnetic characteristics.

However, since Comparative Materials 1 to 4 did not satisfy the steel composition of the present invention, the increase in Goss structure fraction was relatively small, and since Comparative Materials 5 to 8 satisfied the steel composition of the present invention, the Goss structure fraction was remarkably increased.

The invention claimed is:

1. A wire rod comprising, by weight, C: 0.03 to 0.05%, Si: 3.0 to 5.0%, Mn: 0.98 to 2.0%, Al: 0.02 to 0.08%, N: 0.0015 to 0.0030%, the balance: Fe, and other unavoidable impurities, wherein the wire rod comprises a Goss structure of not less than 2 area %.

2. The wire rod of claim 1, wherein the wire rod has a saturated magnetic flux density of not less than 180 emu.

3. A steel wire comprising, by weight, C: 0.03 to 0.05%, Si: 3.0 to 5.0%, Mn: 0.98 to 2.0%, Al: 0.02 to 0.08%, N: 0.0015 to 0.0030%, the balance: Fe, and other unavoidable impurities, wherein the wire comprises a Goss structure of not less than 7 area %.

4. The steel wire of claim 3, wherein the steel wire has a saturated magnetic flux density of not less than 250 emu.

5. A method for manufacturing a wire rod comprising:

heating steel comprising, by weight, C: 0.03 to 0.05%, Si: 3.0 to 5.0%, Mn: 0.98 to 2.0%, Al: 0.02 to 0.08%, N: 0.0015 to 0.0030%, the balance: Fe, and other unavoidable impurities, at a temperature of 1000-1100° C.;

groove-rolling the heated steel at a temperature of 900-1000° C. at a cross-section reduction rate of 50-80%; and cooling the groove rolled steel at a rate of 0.1° C/s or less.

6. A method for manufacturing steel wire comprising drawing the wire rod manufactured by the method of claim 5.

7. The method of claim 6, wherein the drawing is performed at a cross-section reduction rate of 10-80%.

* * * * *